US005209181A

United States Patent [19]

Flood

[11] Patent Number: 5,209,181

[45] Date of Patent: May 11, 1993

[54] SURGICAL TUBE PAINTING MACHINE

[75] Inventor: James R. Flood, Mishawaka, Ind.

[73] Assignee: Spectra, Inc., Mishawaka, Ind.

[21] Appl. No.: 739,985

[22] Filed: Aug. 2, 1991

[51] Int. Cl.[5] ..... B05C 5/00

[52] U.S. Cl. ..... 118/322; 118/324; 118/642

[58] Field of Search ..... 118/309, 319, 322, 324, 118/326, 642, 643

[56] References Cited

U.S. PATENT DOCUMENTS 5,060,594 10/1991 Tomioka et al. ..... 118/34
5,078,083 1/1992 DiMaio et al. ..... 118/322

*Primary Examiner*—W. Gary Jones
*Assistant Examiner*—Charles K. Friedman
*Attorney, Agent, or Firm*—James D. Hall

[57] ABSTRACT

A machine for precisely painting large numbers of small various sized tubular pieces. The painting machine includes a chain driven track assembly which moves the tube pieces held on paint fixtures into a paint chamber for painting and into an oven to dry the paint to the tube.

26 Claims, 4 Drawing Sheets

Fig. 3
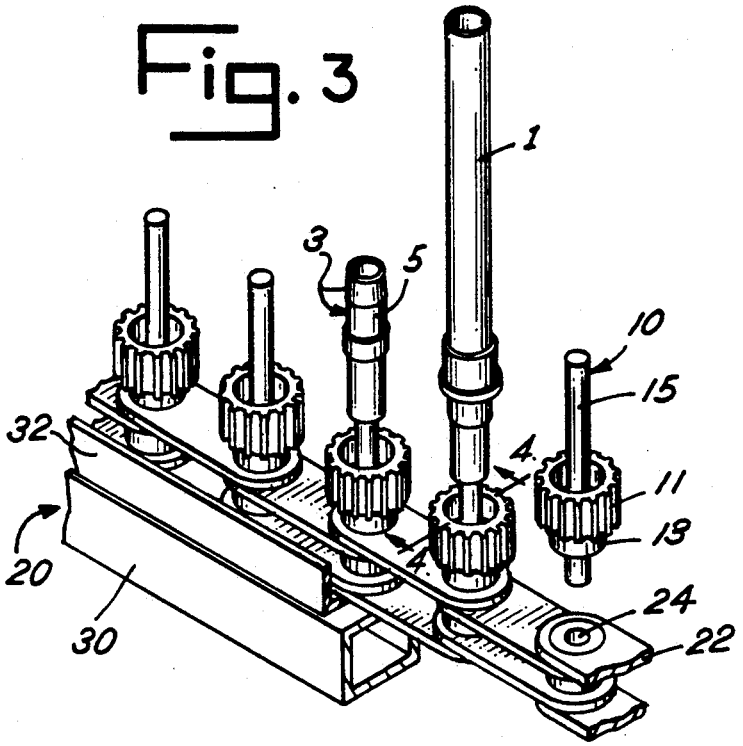
Fig. 4
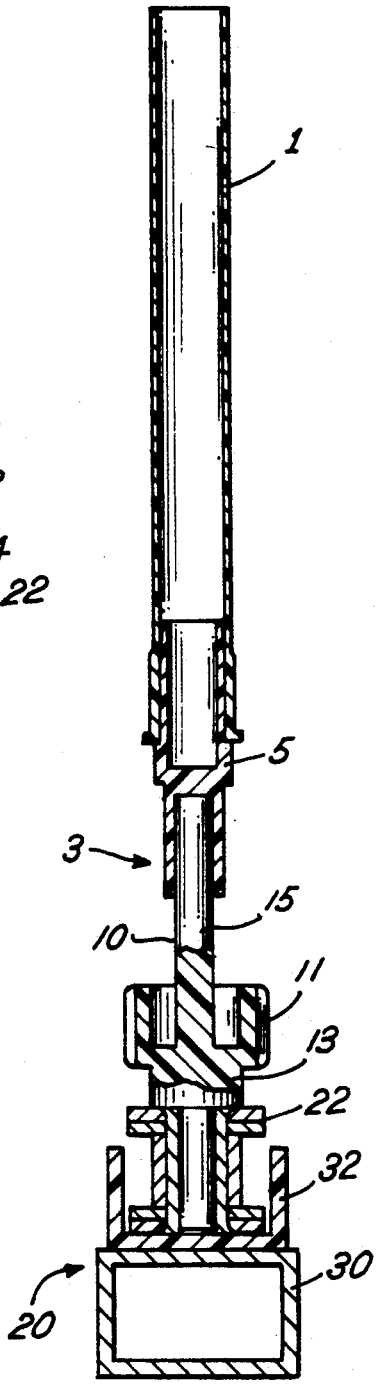
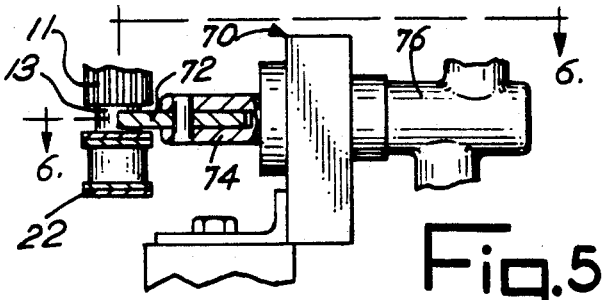
Fig. 5
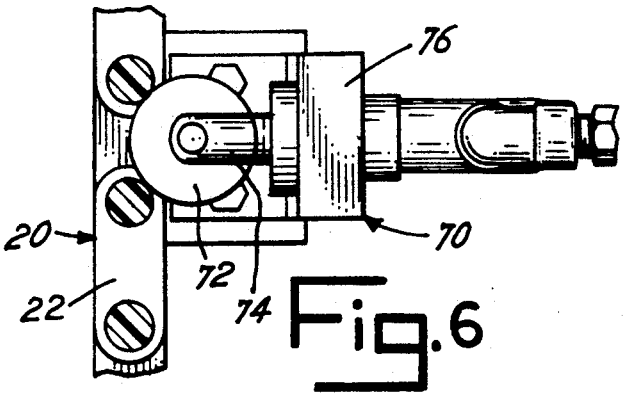
Fig. 6

SURGICAL TUBE PAINTING MACHINE

FIELD OF THE INVENTION

This invention relates to a painting machine for the painting of small cylindrical objects, and will have special application to painting machines for the painting of tubular surgical instruments used in orthoscopic surgery.

SUMMARY OF THE INVENTION

In recent years, the rapid development of orthoscopic surgical techniques as used in orthoscopic surgery and other surgical procedures has vastly altered the traditional impressions of medical surgery. Orthoscopic technology allows the surgeon to perform many surgical procedures without the traditional large incisions. Orthoscopic surgery employs thin walled tubes inserted into small quarter to half inch incisions in the patient. Once the tubes are placed into the body, the surgeon can pass a variety of optical and surgical instruments through the tubes directly into the body. These optical instruments allow the surgeon to remotely explore and view the internal tissues in great detail and magnification on a monitor. While viewing the operation using the optics inserted through a tube, the surgeon performs the delicate procedures through the same or other inserted tubes. The surgeon can remove and repair tissue with great precision while decreasing tissue trauma and recovery time caused by traditional surgical techniques.

The surgical tube is a key instrument in orthoscopic surgery. Such tubes are made in a broad range of diameters and lengths in order to accommodated a variety of surgical instruments. The tubes must be strong and rigid to navigate into joints and other difficult internal body areas. Therefore, the tubes are generally made of a fiberglass material, which must be painted to seal the sleeve material in order to prevent contamination or infection. The paint must be applied evenly and precisely. Like all medical instruments, the instrument sleeves must be crafted to exact tolerances and specifications. In addition, the instrument tubes are not reusable because of the potential incidence of blood related diseases and the inconvenience of sterilization. Accordingly, production of these tubes must be cost efficient.

This invention provide a method for precisely painting the exterior of large numbers of the orthoscopic instrument sleeves and similar small tubular pieces of various sizes. The invention includes a conveyor, a paint chamber and an oven. The conveyor carries replaceable sprocket fixtures. The tube are placed on the fixtures which secure the tubes in a vertical position. The conveyor transports the tubes to the various stages of the paint process. As the tubes enter the paint chamber, a toothed sprocket engages a toothed belt drive which spins the tubes as they move through the chamber. The tubes spin at a controlled and uniform rate as the paint guns apply the paint, allowing an even coating of the tubes. Multiple paint guns apply a coat of paint to each of the spinning tubes. As each tube enters the paint chamber, a trigger device engages a roller and piston which activates the paint gun, applying paint to that tube which is then in position. The fixtures which carry the tubes are in such alignment that as one tube exits the chamber another tube moves into position for painting in a continuous cycle. The freshly painted tubes then enter an oven chamber where the paint is baked dry. As the tubes exit from the oven chamber, the tubes are given a short blast of cooling air. The cooling blast is triggered by the same device which triggers the paint guns. The conveyor then carry the fixtures and tubes to an area where the painted tubes are removed from and unpainted tubes are placed on the fixtures to continue the process.

Accordingly, an object of this invention is to provide a novel integrated painting system for precisely painting the exterior of tubular pieces of various sizes.

Another object of this invention is to provide a machine for precisely controlling the application of paint to tubular pieces.

Another object of this invention is to provide a machine for painting large numbers of tubular pieces.

Another object of the invention is to provide a machine which is for painting tubular pieces and which can be quickly modified to accommodate various sizes and diameters of tubular pieces.

Other objects of this invention will become apparent upon a reading of the following description.

BRIEF DESCRIPTION OF THE DRAWINGS

A preferred embodiment of the invention has been chosen for purposes of illustration wherein:

FIG. 3 is a perspective view of the chain, sprocket, tube and tube fixtures with progressive components exploded to reveal their full detail FIG. 4 is a side plan view of the chain drive assembly, the sprocket, tube and tube fixtures;

FIG. 5 is a side view of the trigger assembly;

FIG. 6 is a top view of the trigger assembly;

DESCRIPTION OF THE PREFERRED EMBODIMENT

Figure 1:
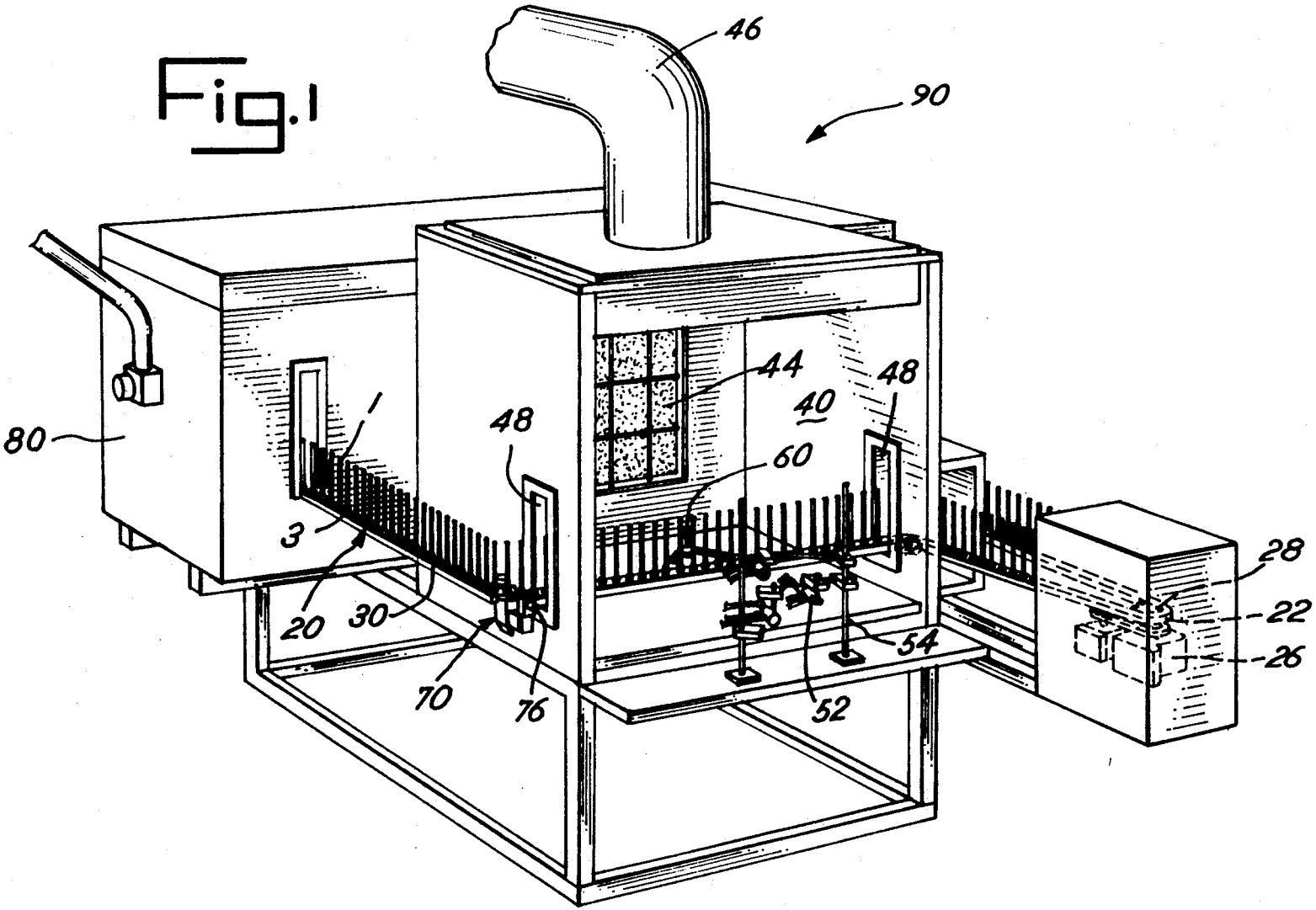
FIG. 1 is a perspective view of the tube painting machine.
Figure 2:
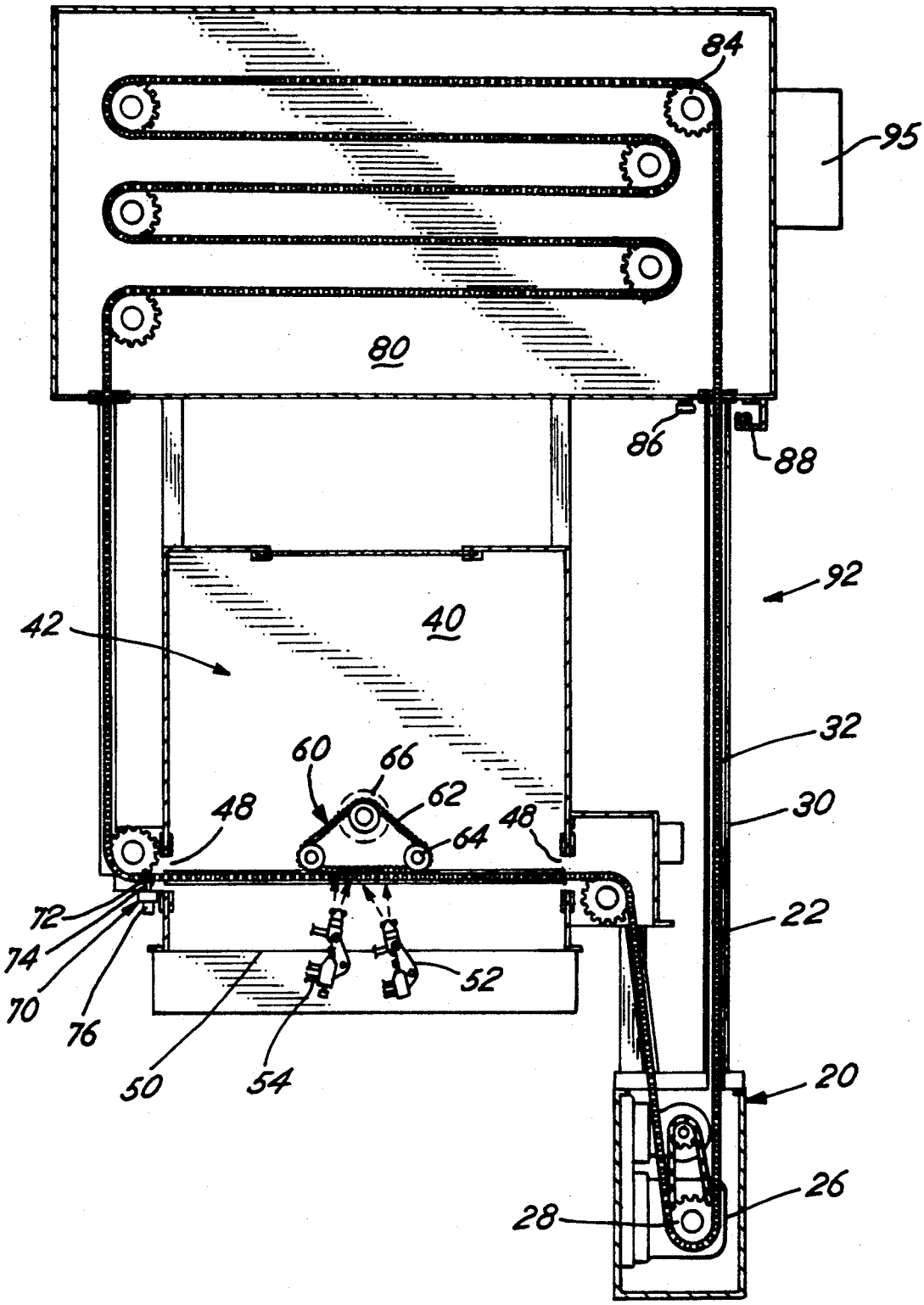
FIG. 2 is a top plan view thereof.
Figure 7:
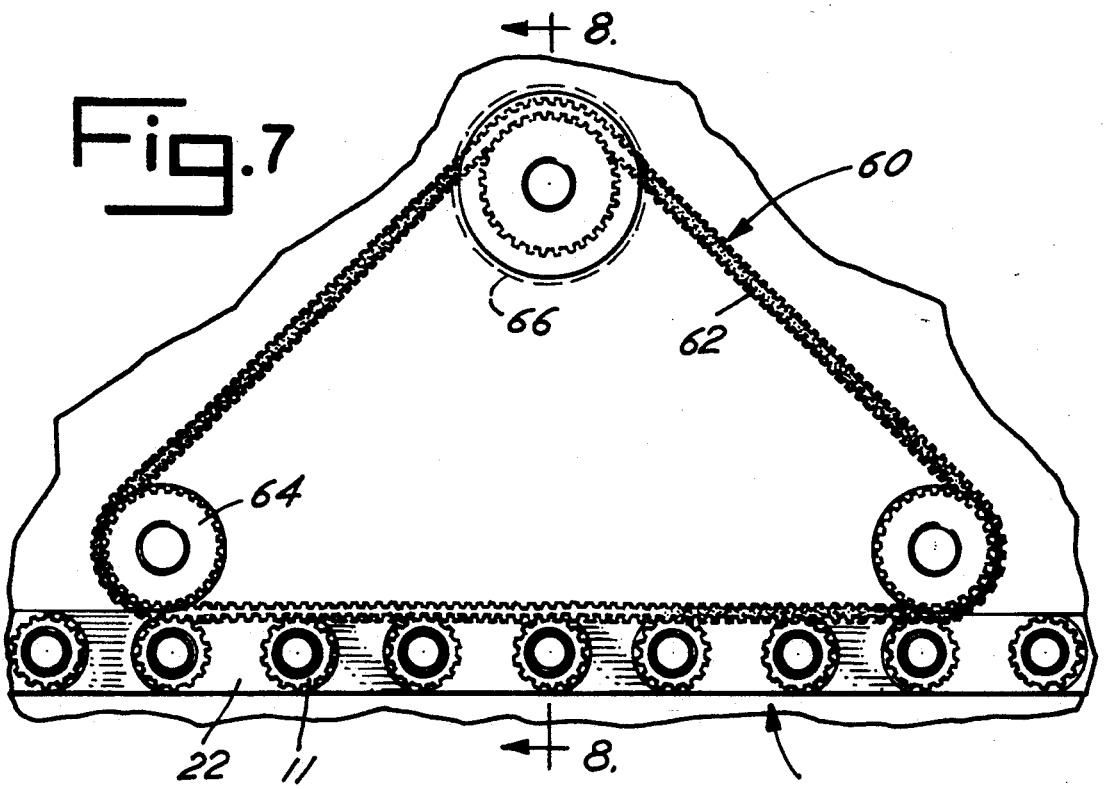
FIG. 7 is a top plan view of the tube spin assembly.
Figure 8:
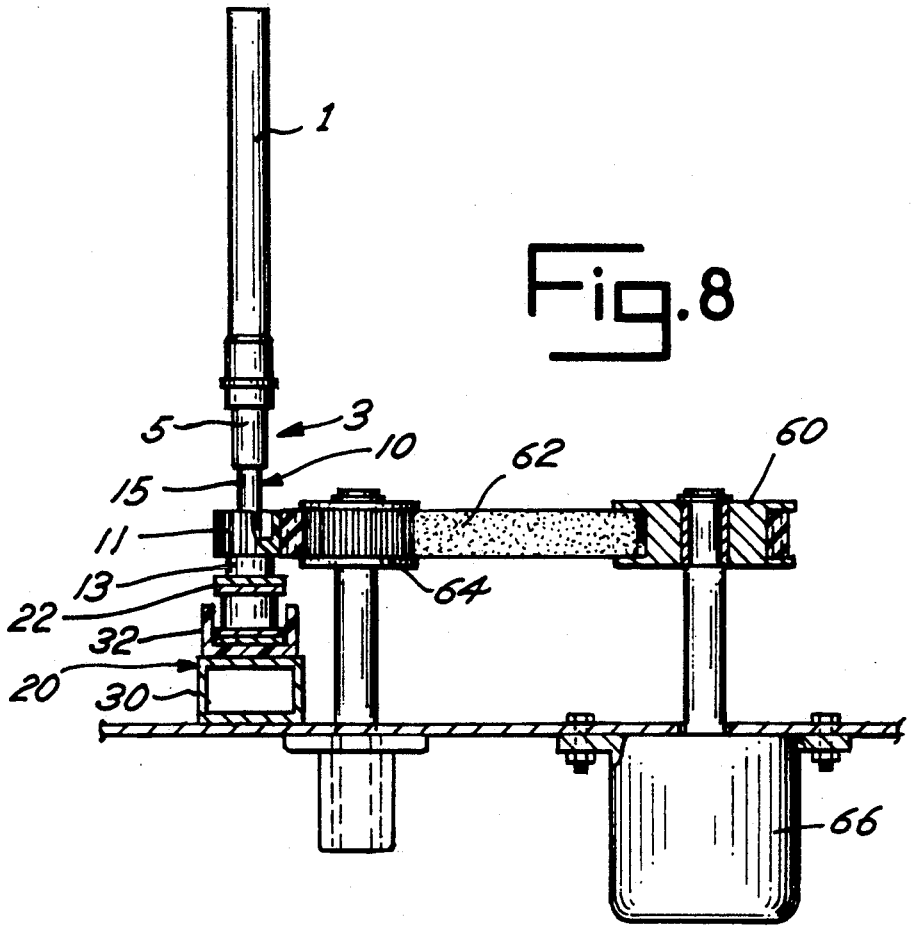
FIG. 8 is a side plan view of the tube spin assembly.

The preferred embodiment herein described is not intended to be exhaustive or to limit the invention to the precise form disclosed. It is chosen and described to explain the principles, application and practical use of the invention to thereby enable others skilled in the art to utilize the invention.

The paint machine 90 has five major component, instrument sleeve or tube 1, tube fixture 3, conveyor assembly 20, spin assembly 60, paint chamber 40, and the oven chamber 80.

Each tube fixture 3 includes two connected molded pieces, fitting head 5 and fixture sprocket 10. Fixture sprocket 10 is a single molded piece having a longitudinal shaft 15 with an annular toothed sprocket gear 11 and smooth annular ring 13 directly below the gear. Sprocket gear 11 and sprocket ring 13 are generally positioned below an intermediate point on shaft 15, in which that portion of shaft 15 extending above sprocket gear 11 is greater than that portion of shaft 15 which extends below ring 13. Sprocket gear 11 generally has a larger outer diameter than ring 13. The reason for these dimensional distinctions will become obvious as they are subsequently explained in greater detail.

Tube fitting head 5 is press fit onto the upper end of shaft 15. Fitting head 5 has an outer shape and dimension for connectively accommodating one end of tube 1. Tube 1 snugly and slidably fits over and rests upon the exterior of fitting head 5. Fitting head 5 and fixture sprocket 10 combine to provide an integrated component that can be readily changed while conveyor assembly 20 continues in operation. Fitting heads 5 of different configurations may be changeably placed on fixture sprockets 10 to accommodate a variety of instrument tube sizes and configurations.

Tubes 1 are transported by flat link chain 22 with the links pivoting in a horizontal plane while being driven by drive motor 26. Chain 22 has hollow link pins 24, as best illustrated in FIG. 3. Hollow link pins 24 slidably accept the ring end of shaft 15. The engagement of hollow link pin 24 and shaft 15 act to hold fixture 3 and tubes 1 in a vertical attitude over the entire track of conveyor link chain 22.

Conveyor assembly 20 transports tube fixtures 3 and tubes 1 through the various operational stages of the paint machine 90. Chain 22 is driven by drive motor 26, which rotates horizontal drive gear 28, which is meshed with chain 22. Chain 22 rides through conveyor guide 32 supported by a conveyor track 30. Guide 32 extends along and defines the path of chain 22, except inside oven chamber 80. Conveyor guide 32 is made of teflon or any acceptable plastic material which allows chain 22 to slide smoothly across the guide. Conveyor track 30 commences at the exit of oven chamber 80 and extends along user access area 92 except for a generally straight long open segment where one or more persons place and remove tubes 1 on and from tube fixtures 3. It is also at access area 92 that tube fixtures 3 may be interchanged and replaced by the fixtures 3 with fitting heads of a variety of sizes or configuration.

Conveyor 20 transports tubes 1 into paint chamber 40. Conveyor 20 and tubes 1 enter paint chamber 40 through elongated vertical openings 48 in the side of paint chamber 40. Openings 48 are of sufficient height and width to accommodate a variety of sizes of instrument tubes 1, while minimizing the size of openings 48 to prevent paint fumes from escaping. Paint chamber 40 has three side walls and a top and bottom cover with an open front 50. Inside paint area 42, paint chamber 40 has fume filters 44 and an air duct 46 for removing paint fumes. Conveyor 20 travels through painting area 42 across open front 50 of paint chamber 40. Open front 50 contains paint gun mounting racks 54. Paint gun mounting racks 54 support and position paint guns 52. Paint guns 52 and mounting racks 54 are easily accessible to users for changing, cleaning and adjusting the paint guns.

A paint spray may be delivered by a single paint gun 52 or by a multiplicity of paint guns 52. Paint guns 52 are positioned such that each gun 52 applies a paint spray to a different area of tube 1, insuring a consistent even coating.

Paint guns 52 are automatically triggered to fire a paint spray when tube 1 is in the proper position inside paint chamber 40 by the movement of sprocket ring 13 across a pneumatic trigger piston 70. Sprocket ring 13 of a preceding fixture on the conveyor engages a trigger roller 72. The movement of conveyor 20 forces each sprocket ring 13 across trigger roller 72 to depress piston shaft 74, thereby releasing the pneumatic piston valve 76 and firing paint guns 52. The trigger piston 70 may be mounted at any location along conveyor track 30. Generally trigger piston 70 is located near the exit opening 48 of paint chamber 40 to allow for ease of pneumatic adjustments. Trigger piston 70 is mounted and adjusted in relation to conveyor 20 such that sprocket ring 13 of one tube fixture 3 and tube 1 depresses trigger piston 70 to activate paint gun 52 just as a tube 1 reaches the painting position inside paint chamber 40. Inside paint chamber 40 is located spin assembly 60. An independent spin motor 66 drives three gears 64 to turn a toothed belt 62. Gears 64 are triangularly positioned to create a straight segment parallel to conveyor track 30. As conveyor 20 carries tube fixtures 3 and tubes 1 past spin assembly 60, belt 62 engages sprocket gears 11. The rotation of belt 62 and the movement thereacross of conveyor 20, cause fixture 3 and tubes 1 to rotate rapidly. The spin assembly's straight parallel segment is of sufficient length to engage several sprocket gears 11 at the same time. The spinning of tubes 1 assists in the even application of the paint and prevents paint runs.

After freshly painted tubes 1 leave paint chamber 40, conveyor 20 carries them to oven chamber 80. In oven chamber 80, tubes 1 are exposed to a high temperature to dry and cure the freshly applied paint. The temperature of oven chamber 80 is externally controlled by and adjustable through a central control box 95. Inside oven chamber 80, conveyor 20 winds around a series of oven conveyor gears 84, allowing instrument tubes 1 additional exposure time in the oven chamber.

As each tube 1 exists oven chamber 80, an air jet 86 gives each tube 1 a blast of cool air sufficient to lower the temperature of tube 1 to permit handling by the operator. An optical counting device 88 is also placed at the exit from oven chamber 80 to count the number of tubes painted in a session and cumulatively. After exiting the oven chamber 80, conveyor 20 delivers the tubes 1 to access area 92. Operators then remove painted tubes 1 and place unpainted tubes 1 on tube fixtures 3.

The conveyor and spin assembly speeds are independently controlled at central control panel 95. This allows the operator to regulate and control the paint application on tubes 1. Central control panel contains the switches, valves, regulators and gages for the pneumatic systems.

It is understood that the above description does not limit the invention to the embodiment herein described, but that it may be modified within the scope of the appended claims.

I claim:

1. A machine for painting a plurality of tubular objects comprising:

a paint chamber, means for painting said tubular objects when the tubular objects are within said painting chamber, mounting means for supporting said tubular objects during said painting, spinning means for rotating said mounting means during said painting within said paint chamber, trigger means for actuating said painting means when said tubular objects are within said paint chamber, an oven chamber for drying said tubular objects of said paint, and conveyor means for transporting said mounting means from said paint chamber to said oven chamber.

2. the machine of claim 1 wherein said conveyor means includes a continuous linked chain trained about toothed guide gears, motor means for driving said chain about said guide gears, and a guide track means for supporting said chain.

3. The machine of claim 2 wherein said chain includes pins carrying said mounting means.

4. The machine of claim 3 wherein said mounting means includes a plurality of sprocket fixture means for detachably supporting said tubular objects, each sprocket fixture means being connected to one of said chain pins.

5. The machine of claim 4 wherein each said sprocket fixture means includes elongated shaft means for detachable rotative connection to one of said chain pins.

6. The machine of claim 5 wherein each sprocket fixture means includes integral gear means journaled through said shaft means for coactive engagement with said spinning means.

7. The machine of claim 6 wherein said spinning means includes an exteriorly toothed belt rotatively trained about at least two pulleys forming a substantially straight section parallel to said conveyor means, means for rotating said belt about said pulleys, said belt engaging said gear means of each sprocket fixture means as said conveyor means transports the sprocket fixture means along said belt straight section, wherein said rotation of said belt rotates the sprocket fixture means.

8. The machine of claim 6 wherein said shaft means includes first end means extending beyond said gear means for connective axial engagement with said tubular objects and second end means extending oppositely beyond the gear means for detachable rotative connection with said chain pins.

9. The machine of claim 4 wherein said painting means includes a paint gun, said trigger means includes a switch means for engagement with a said sprocket fixture means as said conveyor means transports the sprocket fixture means through said machine to actuate said paint gun, said sprocket fixture means including integral annular roller means journaled through said shaft means with coactive engagement with said switch means.

10. The machine of claim 1 wherein said conveyor means includes a section of said guide track for placement and removal of said tubes onto said mounting means.

11. The machine of claim 1 wherein said oven chamber includes openings to allow said conveyor means to transport said mounting means therethrough.

12. The machine of claim 11 wherein said conveyor means transports said mounting means back and forth within said oven chamber.

13. A machine for painting a plurality of tubular objects comprising:

a paint chamber, means for painting said tubular objects when the tubular objects are within said painting chamber, mounting means for supporting said tubular objects during said painting, conveyor means for transporting said mounting means through said paint chamber, spinning means for rotating said mounting means during said painting within said paint chamber, said spinning means including a driven belt means in engagement with said mounting means for rotating said mounting means.

14. The machine of claim 13 wherein said conveyor means includes a continuous linked chain trained about toothed guide gears, motor means for driving said chain about said guide gears, and a guide track means for supporting said chain.

15. The machine of claim 14 wherein said chain includes pins carrying said mounting means.

16. The machine of claim 15 wherein said mounting means includes a plurality of sprocket fixture means for detachably supporting said tubular objects, each sprocket fixture means being connected to one of said chain pins.

17. The machine of claim 16 wherein each said sprocket fixture means includes elongated shaft means for detachable rotative connection to one of said chain pins.

18. The machine of claim 17 wherein each sprocket fixture means includes integral gear means journaled through said shaft means for coactive engagement with said spinning means.

19. The machine of claim 18 wherein said spinning means includes an exteriorly toothed belt rotatively trained about at least two pulleys forming a substantially straight section parallel to said conveyor means, means for rotating said belt about said pulleys, said belt engaging said gear means of each said sprocket fixture means as said conveyor means transports the sprocket fixture means along said belt straight section, wherein said rotation of said belt rotates the sprocket fixture means.

20. The machine of claim 18 wherein said shaft means includes first end means extending beyond said gear means for connective axial engagement with said tubular objects and second end means extending oppositely beyond the gear means for detachable rotative connection within said chain pins.

21. The machine of claim 16 wherein said painting means includes a paint gun, trigger means for actuating said painting means when said tubular objects are within said paint chamber, said trigger means includes a switch means for engagement with a said sprocket fixture means as said conveyor means transports the sprocket fixture means through said machine to actuate said paint gun, said sprocket fixture means including annular roller means journaled through said shaft means and abutting said gear means for coactive engagement with said trigger means.

22. The machine of claim 13 wherein said conveyor means includes a section of said guide track for placement and removal of said tubular objects onto said mounting means.

23. The machine of claim 13 and including an oven chamber for drying said tubular objects of said paint.

24. The machine of claim 23 wherein said oven chamber includes openings to allow said conveyor means to transport said mounting means therethrough.

25. The machine of claim 24 wherein said conveyor means transports said mounting means back and forth within said oven chamber.

26. The machine of claim 13 and including a trigger means for actuating said painting means when said tubular objects are within said paint chamber.

* * * * *